US005718253A

United States Patent [19]

McNamee

[11] Patent Number: 5,718,253

[45] Date of Patent: Feb. 17, 1998

[54] RECREATIONAL VEHICLE SCREEN ROOM ENCLOSURE

[76] Inventor: Thomas Charles McNamee, 451 Monaco Dr., Channel Islands, Calif. 93035

[21] Appl. No.: 590,995

[22] Filed: Jan. 24, 1996

[51] Int. Cl.[6] ..... E04F 10/06; E04H 15/06

[52] U.S. Cl. ..... 135/88.13; 135/88.1; 135/88.12; 160/56; 160/67; 24/129 B

[58] Field of Search ..... 135/88.1, 88.11, 135/88.12, 88.13, 88.15, 88.17, 88.18; 160/55, 56, 67; 24/129.13

[56] References Cited

U.S. PATENT DOCUMENTS

| | | | |
|---|---|---|---|
| 4,077,419 | 3/1978 | Lux | 135/88.12 X |
| 4,175,576 | 11/1979 | Iby | 135/88.1 |
| 4,576,192 | 3/1986 | Duda | 135/88.12 |
| 4,640,332 | 2/1987 | Turner | 160/65 X |
| 4,726,153 | 2/1988 | Adler et al. | 135/88.13 X |
| 4,824,057 | 4/1989 | Suprono | 24/129 B |
| 4,929,303 | 5/1990 | Sheth | 156/209 |
| 4,941,524 | 7/1990 | Greer | 160/67 |

FOREIGN PATENT DOCUMENTS

| | | | |
|---|---|---|---|
| 0295299 | 11/1968 | Australia | 135/88.1 |
| 2246416 | 5/1975 | France | 135/88.1 |
| 2527429 | 12/1983 | France | 135/88.1 |

*Primary Examiner*—Carl D. Friedman
*Assistant Examiner*—Winnie Yip
*Attorney, Agent, or Firm*—Michaelson & Wallace

[57] ABSTRACT

A screen room enclosure for use with an RV having an awning rail and an awning coupled to the awning rail, the enclosure comprising a side panel having a top edge, a first cord coupled to the top edge and having a first engagement means at an end adjacent the awning rail, and a first channel clip comprising a planar section having a slot engageable with the first engagement means, and a non-planar section engageable with the awning rail.

29 Claims, 10 Drawing Sheets

RECREATIONAL VEHICLE SCREEN ROOM ENCLOSURE

BACKGROUND OF THE INVENTION

1. Technical Field

The present invention relates to an improved screen room enclosure for recreational vehicles and to means and methods for securing screen room enclosures to recreational vehicles.

2. Background Art

Screen room enclosures ("SRE") have become popular accessories for use with recreational vehicles ("RVs"). When attached under the awning and to the side of an RV, an SRE provides additional living space outside the RV that is protected from outdoor annoyances. For example, an SRE can provide protection from adverse weather, such as wind and rain, and bothersome animals, such as insects and squirrels.

A typical SRE 100 is shown in FIG. 1 and the structural components consist of a front panel 105 and side panels 110. An SRE may also include privacy panels 115, which are shown in a rolled up position, to cover screens 116 and a door 120. The components of the SRE are attached to existing RV components, such as an awning 125, roller tube 130 and RV side 135. Awnings 125 are typically attached to the RV side 135 by sliding a welt 140 at the edge of the awing into an awning rail 145 that is permanently attached to the RV side 125.

An installation of such an SRE 100 is difficult, time consuming and requires drilling numerous holes in the RV components. Holes are typically drilled in the RV side 135 to install hardware that is used to support the side panels 110 against the RV. In order to assure adequate support of the SRE 100, existing SREs use permanent types of fasteners such as screws, snaps, studs and brackets. For example fasteners 150, such as metal snaps or twist lock fasteners, are used to secure a flap 155 of the side panel 110 to the RV side 135.

In addition to requiring substantial installation labor, the use of fasteners 150 has other significant disadvantages. For example if the owner of an SRE 100 desired to shorten the length of the SRE, a new set of holes would have to be drilled in the RV side 135 and a second set of fasteners 150 would have to be installed. In addition, if the owner desired to transfer the SRE 100 to a new RV, the holes and fasteners 150 in the first RV would be difficult and expensive to remove. If they were not removed, their continued utility would be doubtful unless a subsequent owner purchased an identical model SRE.

An SRE 100 of the prior art also requires substantial hardware to support the top of the side panels 110 to the sides of the awing 125. For example a sleeve 160 at the top of the awning 125 is threaded over a spring-loaded tube or rafter 165, which is supported between the roller tube 130 and RV side 135. An installation of the rafter 165 typically requires drilling a hole in the roller tube 130 and compressing a non-skid ferrule 170 against the RV side 135 until a dowel in the rafter 165 is inserted in the hole in the roller tube.

A typical installation of a side panel 110 also has several disadvantages. As described previously, holes are drilled in the roller tube 130, which holes are a permanent modification to the RV. In addition, each time the SRE 100 is erected, the rafters 165 must be threaded into the sleeves 160, which is time consuming and tedious.

Installation of the front panel 105 of a prior art SRE 100 also poses several disadvantages. Typically, a polycord or welt 175 is threaded into a channel 180 in the roller tube 130 that runs the length of the panel 105. Different manufacturers of awnings 125 use channels 180 having different dimensions. This requires that different size welts 175 be sewn into the top of the panel 105 to fit properly in the channel 180. Thus, a selected prior art SRE 100 can only fit the channel 180 in a specific awning 125. In addition, the roller tubes 130 typically have only three channels 180, one of which is used to support the awning 125, one of which is used to support a valance 185, leaving only one channel 180 that may by used to support the front panel 105 of an SRE 100. Thus, there is no convenient means to support other RV accessories such as an auxiliary awning or lighting while the SRE is erected.

Another significant disadvantage of prior art SREs is a lack of adequate sealing of the side panels 110 to the awning 125 and the RV sides 135, which allows insects and wind to enter the SRE. For example at the junction between the top of the side panels 110 and the awning 125, the rafter 165 serves as a rigid hanger for the side panel. Since it is difficult to install the non-skid ferrule 170 flush with the awning rail 145 and the other end of the rafter 165 flush with the roller tube 130, obtaining an alignment of the rafter 165 with an adjacent edge of the awning 125 is frustrated. Thus, this structure prevents the top of the side panel 110 from forming a seal with the awning 125, or even from touching the awning at times.

In addition, there is a wide variation in the material and designs of the RV sides 135 between different manufacturers. RV sides 135 may be of a flat design, a stepped structure, or various corrugated patterns. Because of this variety of surface textures on the RV sides 135, forming a seal at the junction of the side panels 110 with the RV sides 135 is prevented.

Thus, it is an object of the invention to provide an SRE that may be quickly and easily installed. It is also an object of the invention to provide an SRE that may be quickly and easily erected and disassembled at the desired campsite.

Another object of the invention is to afford an SRE that does not require any permanent hardware to be installed on the RV. Specifically, it is an object to provide installation means that do not require the drilling of any holes in the RV or any of its attachments, such as the awning 125 or roller tube 130.

It is a further object of the invention to provide an SRE with improved means to seal the junctions between the side panels 110 and the RV sides 135 and awning 125. In addition, it is an object to afford an SRE that can maintain seals at such junctions when used with a variety of RV sides 135 and awnings 125.

It is another object of the invention to provide an SRE that may be installed in channels 180 having different dimensions and, thus, on roller tubes 130 made by different manufacturers. In addition, it is an object of the invention to provide means to support additional RV accessories while the SRE is erected, such as an extension awning or lights.

SUMMARY OF THE INVENTION

A screen room enclosure for use with an RV having an awning rail and an awning coupled to the awning rail, the enclosure comprising a side panel having a top edge, a first cord coupled to the top edge and having a first engagement means at an end adjacent the awning rail, and a first channel clip comprising a planar section having a slot engageable with the first engagement means, and a non-planar section engageable with the awning rail.

DETAILED DESCRIPTION OF THE PREFERRED EMBODIMENT

Figure 1:
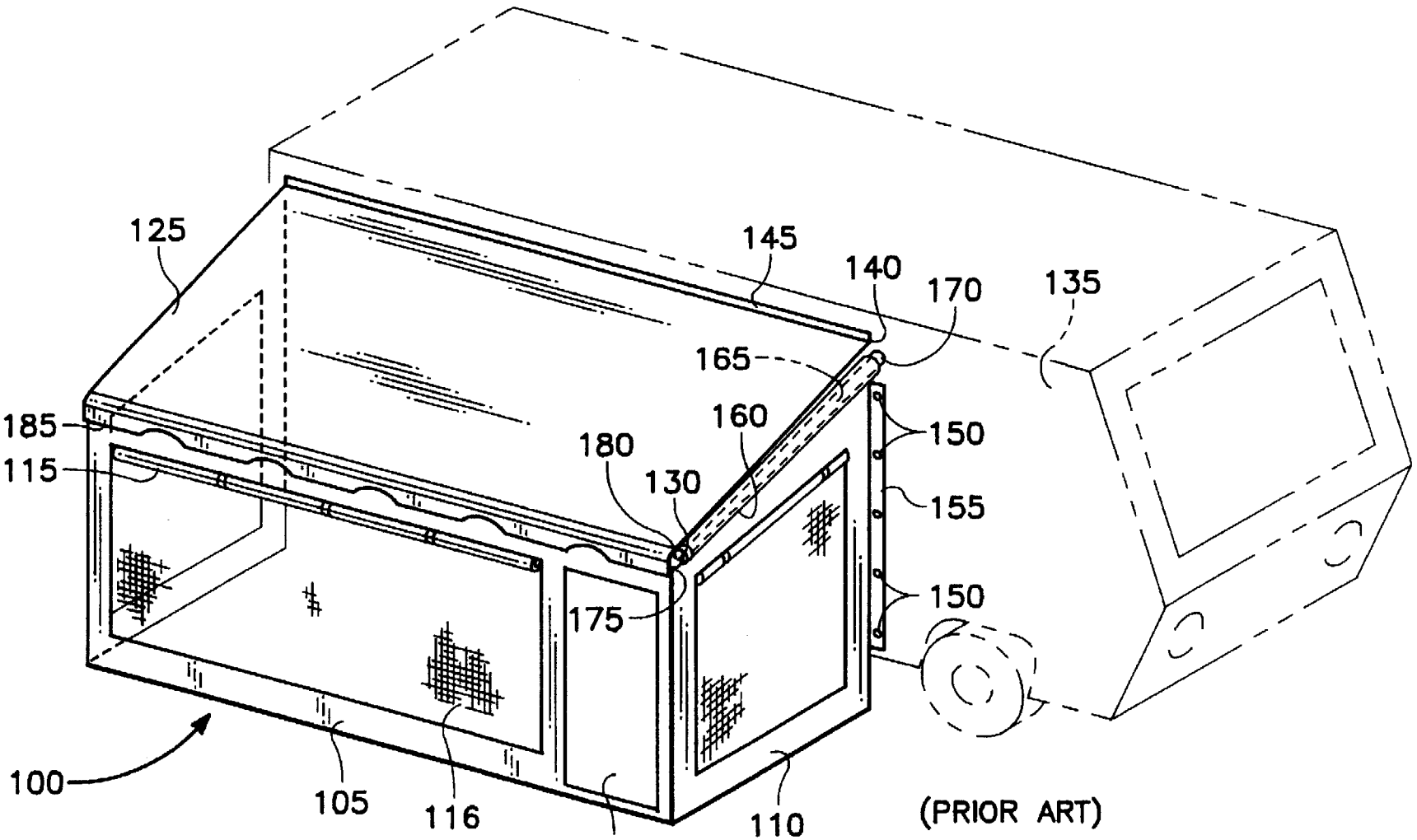
(PRIOR ART) FIG. 1
FIG. 1 is a perspective view of a prior art SRE.
Figure 2:
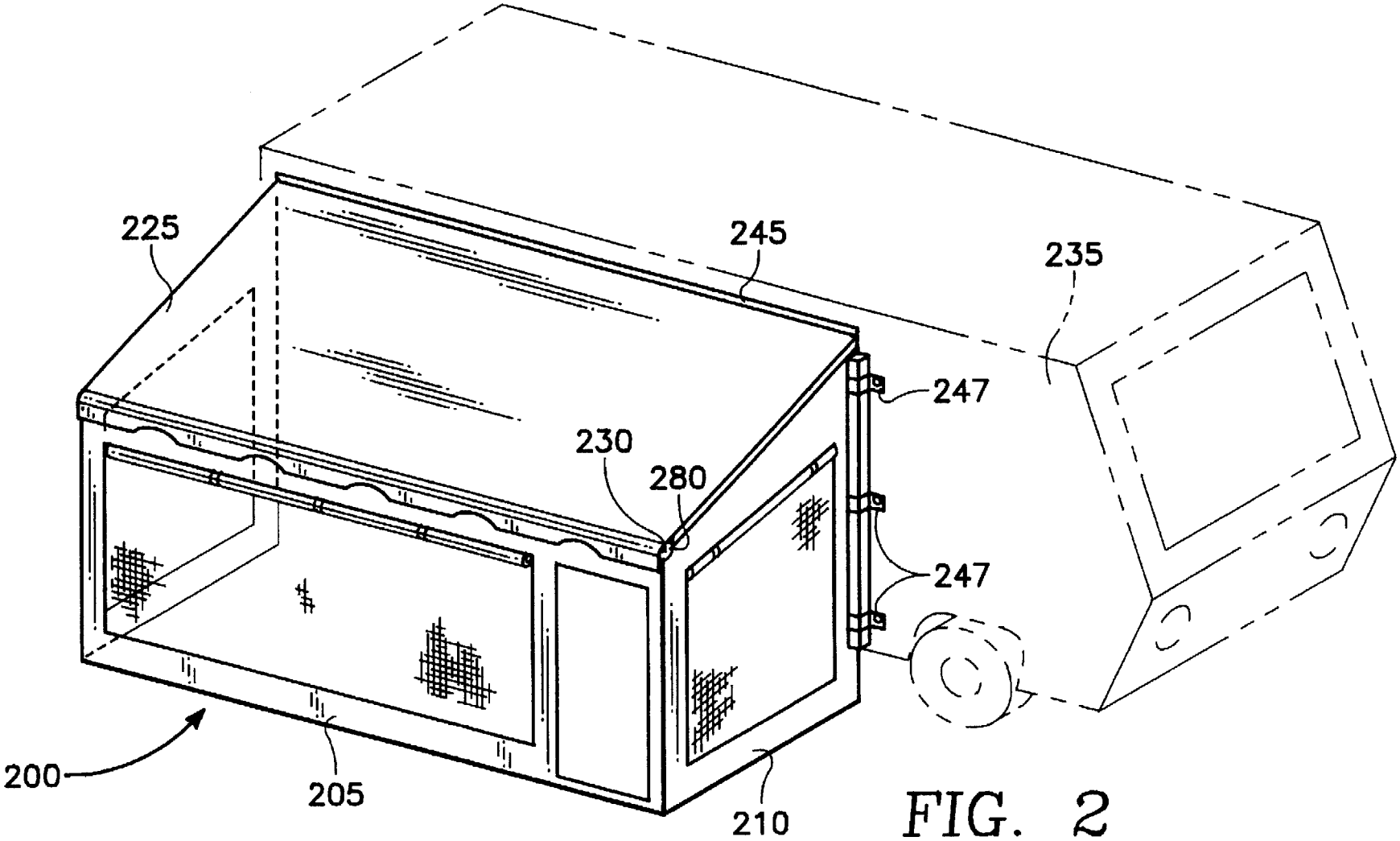
FIG. 2 is a perspective view of an SRE according to the invention.

As shown in FIG. 2, an SRE 200 according to the invention provides many similar components to the prior art SRE 100 (shown in FIG. 1). A front panel 205 is supported by an awning 225, and side panels 210 are supported against an RV side 235 and an awning 225. Significant improvements are provided, however, in the means and methods by which the side panels 210 and front panel 205 are attached to a channel 280 in a roller tube 230, an awning rail 245 and the RV side 235.

Figure 3:
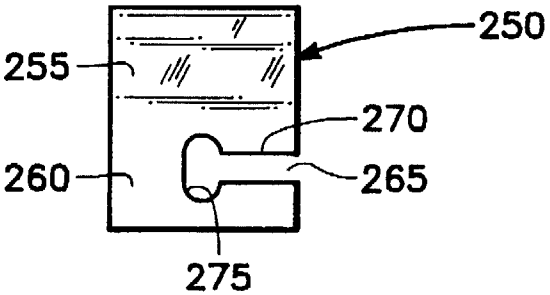
FIG. 3 is a plan view of a channel clip of the invention.

A novel channel clip 250, as illustrated in FIG. 3, is provided that enables the top of the side panels 210 to fit flush with the awning 225 and RV side 235 (all shown in FIG. 2). An arcuate section 255 of the channel clip 250 is formed to mate with the interior surface of the awning rail 245 or channel 280 (both shown in FIG. 2). A planar section 260 is provided with a slot 265 having a narrow section 270 and an expanded section 275.

Figure 4A:
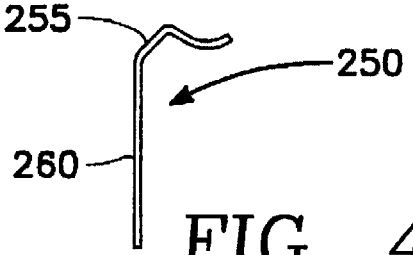
FIG. 4A is a side view of a first embodiment of the channel clip of the invention.
Figure 4B:
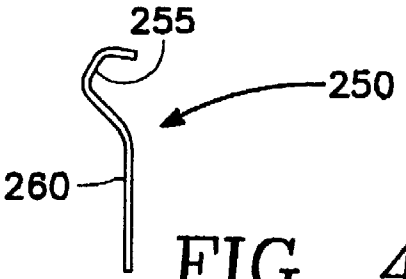
FIG. 4B is a side view of a second embodiment of the channel clip of the invention.

A side view of the channel clip 250 in which the arcuate section 255 has been adapted to mate with the awning rail 245 (shown in FIG. 2) is shown in FIG. 4A. A side view of the channel clip 250 in which the arcuate section 255 has been adapted to mate with the channel 280 (shown in FIG. 2) is shown in FIG. 4B.

Figure 5C:
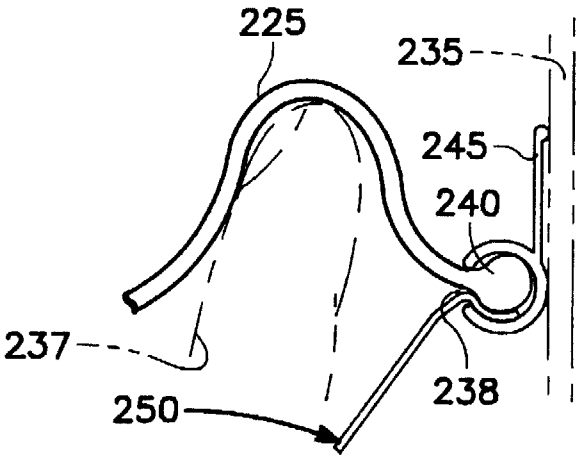
FIGS. 5A through 5D illustrate the steps in an installation of the first embodiment of the channel clip in an awning rail for use with a flexible awning.
Figure 5D:
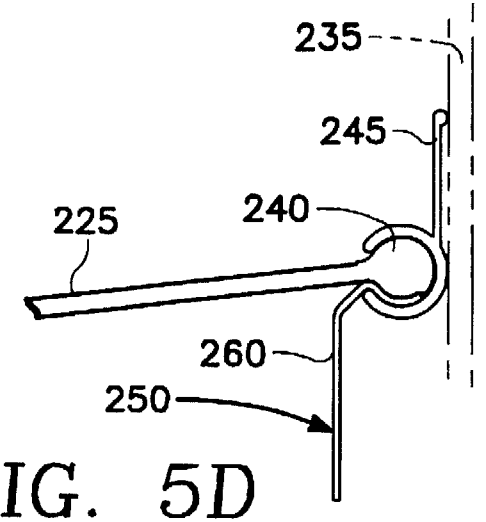
Figure 5A:
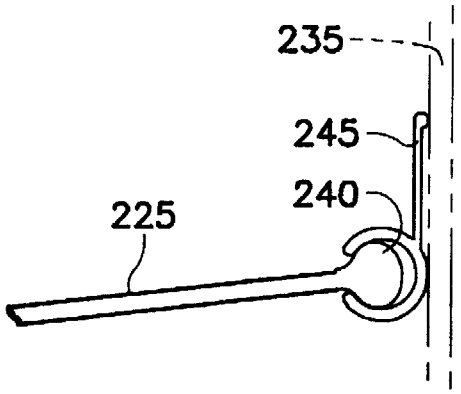
Figure 5B:
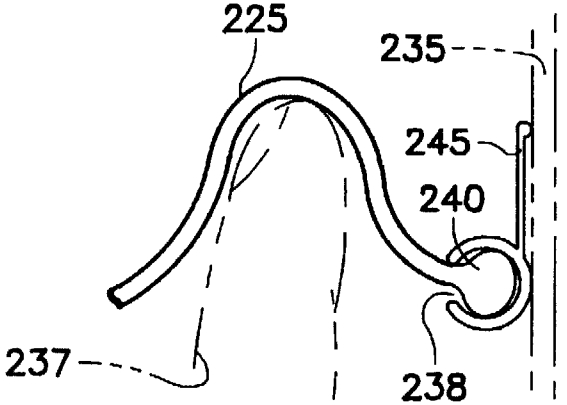

The channel clip 250 provides a secure means to attach a support cord or cable to the awning rail 245 or channel 280 (both shown in FIG. 2) and yet be removable to reinstall the SRE on another RV, or to make change in a current installation. A series of installation steps for the channel clip 250 is illustrated in FIG. 5A through FIG. 5D. FIG. 5A shows a typical awning 225 made of a soft material, such as fabric or vinyl, that lies flat after it has been deployed (as shown in FIG. 2). The awning 225 is held in the awning rail 245 by a welt 240 sewn in an edge of the awning 225 that is to be adjacent the RV side 235. The first installation step is shown in FIG. 5B in which a lifting means 237, such as a human finger or blunt instrument, raises an edge of the awning 225 adjacent the awning rail 245. This action creates a gap 238 between a lower edge of the awning 225 and a lower section of the awning rail 245, which gap has a length of approximately the width of the channel clip 250. As shown in FIG. 5C, the channel clip 250 is inserted into the gap 238 in an elevated position such that the arcuate section 255 is wedged between the interior surface of the awning rail 245 and the welt 240. After insertion, the lifting means 237 is removed as shown in FIG. 5D and the awning 225 returns to a flat position (as shown in FIG. 5A) and the channel clip 250 moves to a position generally parallel with the RV side 235.

The channel clip 250 is held in a fixed position by the compression force of the awning 225 and welt 240 against the lower section of the awning rail 245. This compression force will prevent the channel clip 250 from pulling out of the awning rail 245 or from migrating along the length of the awning rail.

Figure 6A:
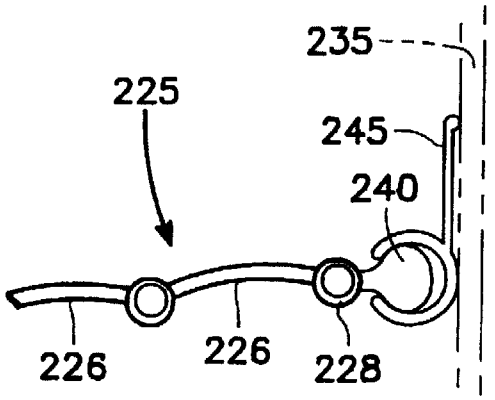
FIGS. 6A through 6D illustrate the steps in an installation of the second embodiment of the channel clip in an awning rail for use with an articulated awning.
Figure 6B:
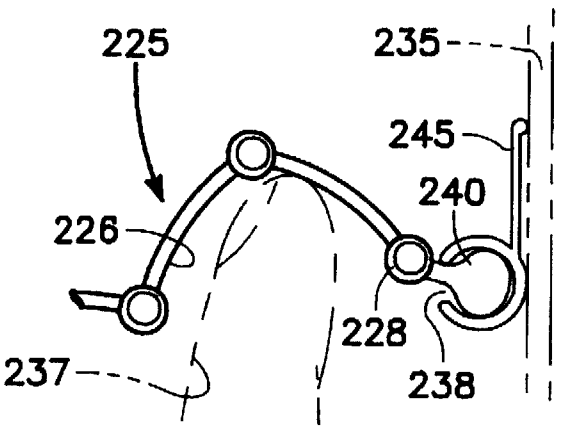
Figure 6C:
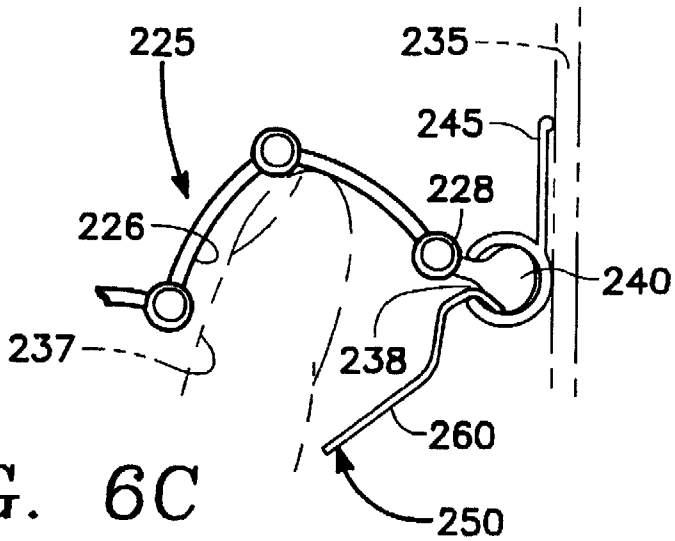
Figure 6D:
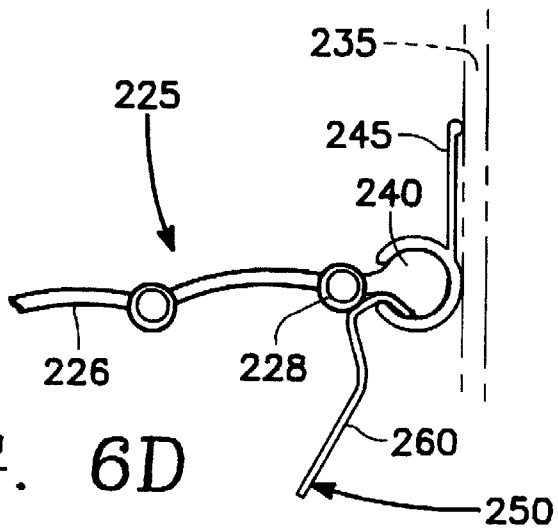

A similar installation technique is illustrated by the steps shown in FIG. 6A through FIG. 6D if the awning 225 is made of a rigid material, such as metal, and is formed as a connected series of articulating blinds 226. In this embodiment, an articulating joint 228 is generally positioned adjacent the awning rail 245. This configuration requires that the arcuate section 255 of the channel clip 250 (shown in FIG. 3) have a different shape than the shape used in FIG. 5 in order that the planar section 260 is positioned generally parallel to the RV side 235 after the lifting force is removed, as shown in FIG. 6D.

Figure 7B:
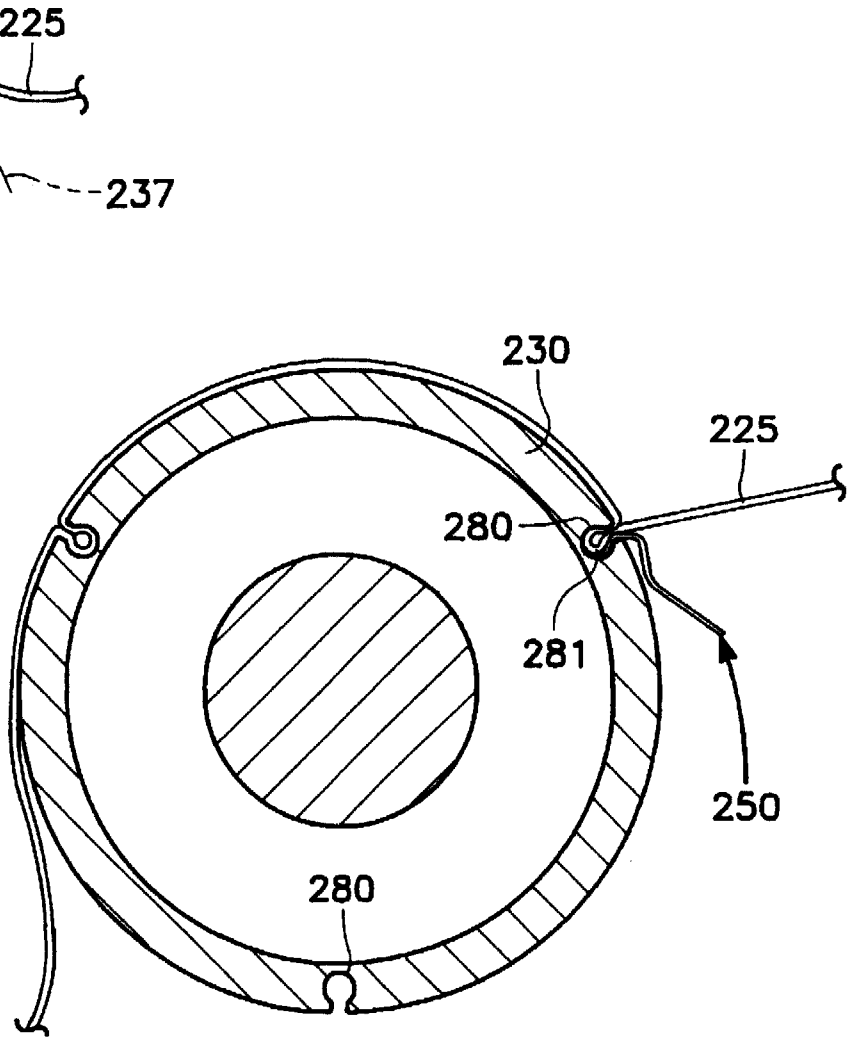
FIGS. 7A and 7B illustrate the steps in an installation of the first embodiment of the channel clip in a roller tube channel.
Figure 7A:
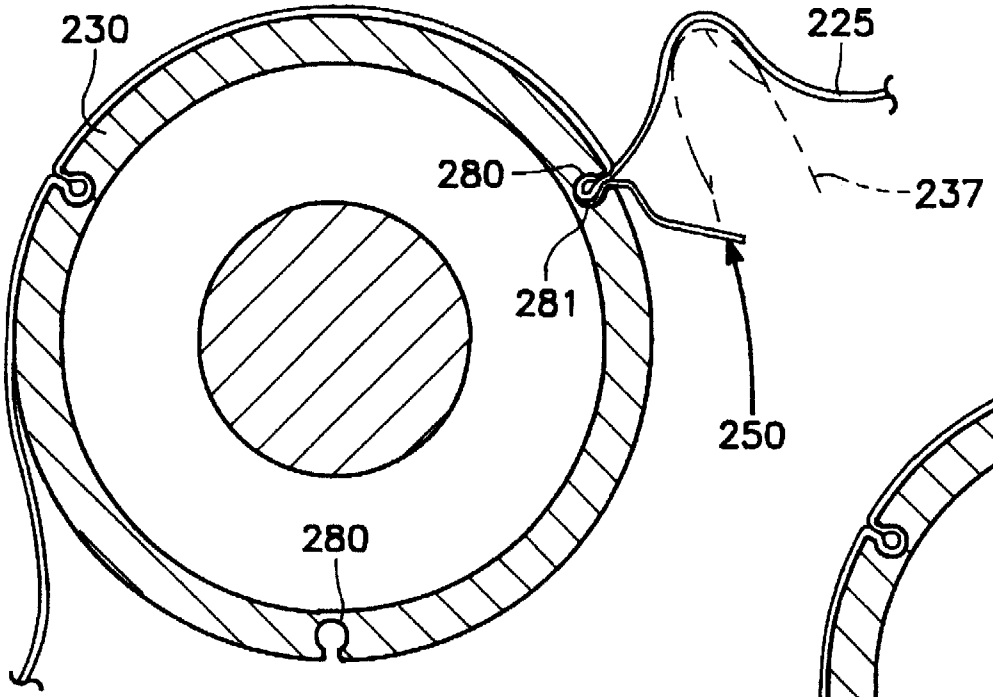

A similar technique is illustrated in FIG. 7A and FIG. 7B for installation of the channel clip 250 in the roller tube 230. prior to full deployment of the awning 225 (i.e., before full tension is applied to the awning 225) a lifting means 237 raises a portion of the awning and the channel clip 250 is inserted between a welt 281 in the awning and the channel 280. After the lifting force is removed as shown in FIG. 7B, the awning 225 returns to a flat position and the channel clip 250 is disposed generally at an acute angle to the awning, such as 45 degrees. Again, the channel clip 250 is held in a fixed position by the compression force of the awning 225 and welt 281 against the lower section of the channel 280.

Figure 8:
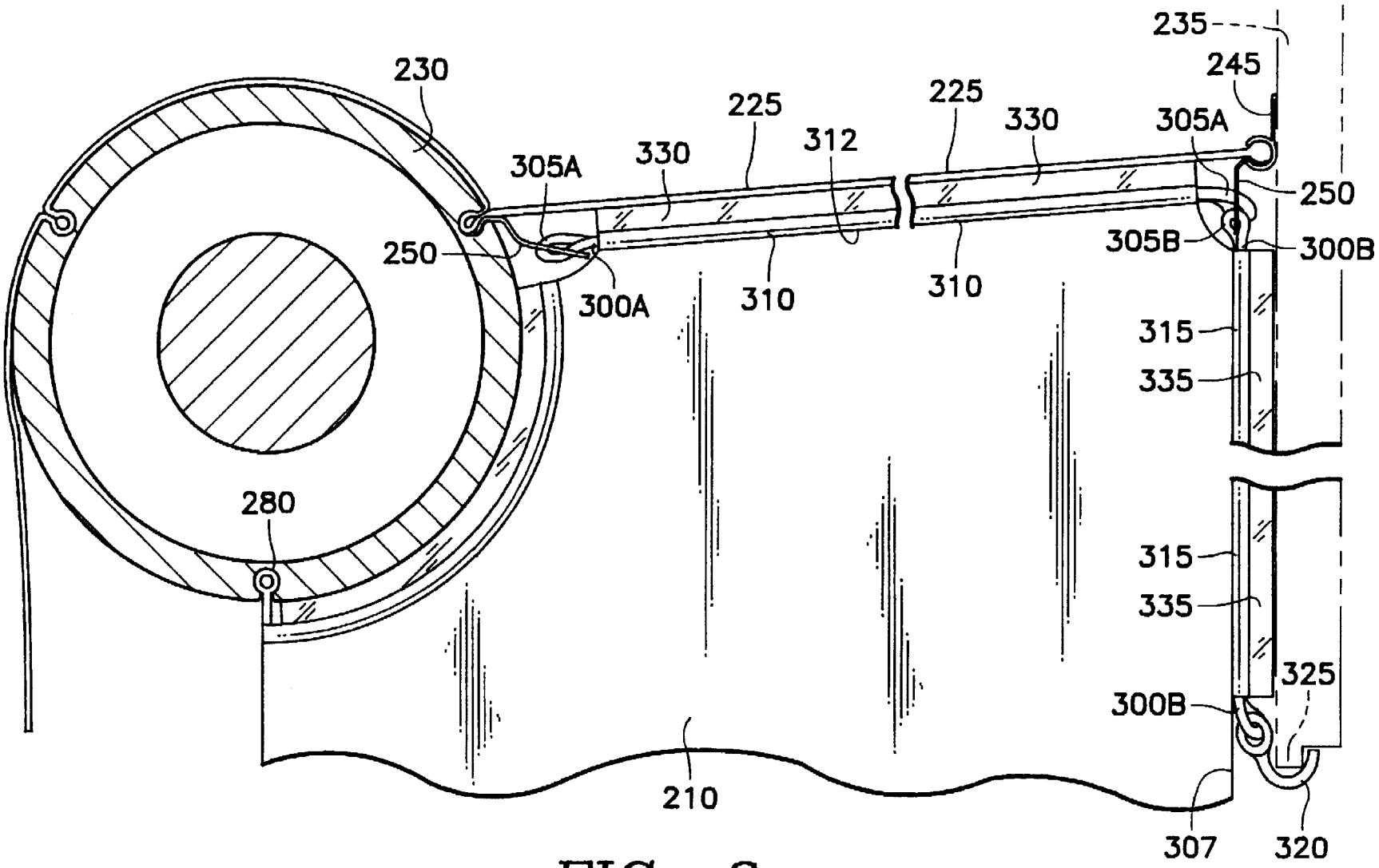
FIG. 8 is a partial side view of a side panel of the invention showing support cords engaged with channel clips.

The method by which the clips 250 that have been installed in the awning rail 245 and the roller tube 230 support the side panels 210 is shown in FIG. 8. An elastic cord 300A having loops 305A at each end is threaded into a sleeve 310 formed in top edges 312 of the side panels 210. To install the side panels 210, an extension force is applied to the cord 300A to extend it to the distance between the roller tube 230 and the awning rail 245 and the loops 305A are engaged with the slot 265 (shown in FIG. 3) in the clips 250. After engagement is this manner, the extension force on the cord 300A is released and the remaining tension produced by the cord 300A holds the top edge 312 in close proximity to the awning 225.

The manner in which the side panels 210 are attached to the RV side 235 is also shown in FIG. 8. An elastic cord 300B having a loop 305B is threaded into a sleeve 315. To install each side edge 307 of the side panels 210, the loop 305B is engaged with the slot 265 (shown in FIG. 3) in the channel clip 250 and an extension force is applied to the cord 300B to extend the lower end to a lip 325 of the RV side 235. This lower end cord 300B is coupled to a conventional engagement means, such as a fastener or hook 320, which engages the lip 325. After engagement is this manner, the extension force on the cord 300B is released and the remaining tension produced by the cord 300B holds the side edge 307 in close proximity to the RV side 235. It should be noted that the loops 305 could be replaced by other conventional engaging means such as knots or hooks.

Use of the cords 300 and clips 250, rather than the rafters 165 of the prior art (shown in FIG. 1), to support the side panels 210 also results in a substantial weight savings. This feature is a substantial advantage over the prior art because of the gross weight capabilities of RVs.

An additional novel feature of the invention illustrated in FIG. 8 relates to the manner in which the top edge 312 is sealed to the awning 225 and the side edge 307 is sealed to the RV side 235. As described previously, prior art SREs did not have a structure that formed a seal at these locations. The use of a rigid rafter 160 adjacent the edge of the awning 125 and flexible fabric of the side panel 110 adjacent the RV side 135 (shown in FIG. 1) did not provide a seal capable of preventing the ingress of adversary weather and flying insects.

An SRE of the invention overcomes this disadvantage by using a novel weather seal device. As shown in FIG. 8, a foam strip 330 is compressed between the sleeve 310 and the awning 225 to form a seal. The foam strip 330 is compressed by the cord 300A that is held in tension between the clips 250. An open cell material is preferred for the fabrication of the strip 330 because it is flexible, while closed cell foams are too rigid to form a tight seal. The strip 330 may be attached to the sleeve or top edge 312 by conventional means, such as adhesive or sewing. A foam strip 335 is used in the same manner to form a seal against the RV side 235. Thus, the strip 335 is compressed against the RV side 235 by the cord 300B that is held in tension between the clip 250 and the hook 320.

Figure 9:
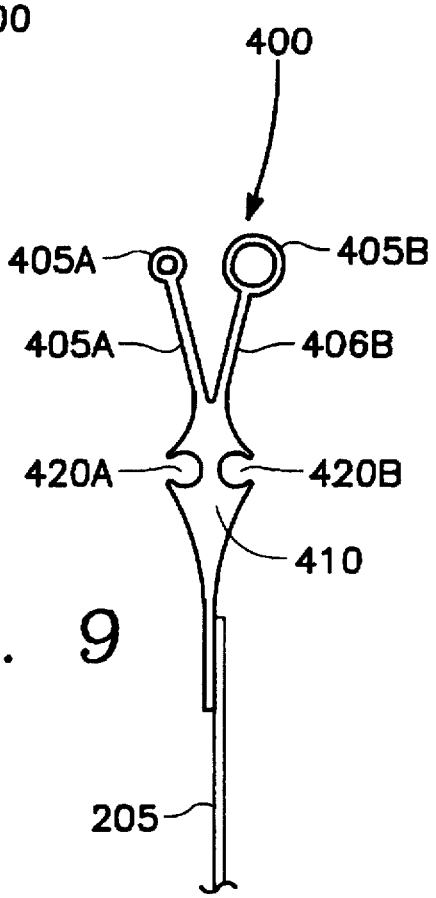
FIG. 9 is a side view of a multiwelt adapter of the invention.

An additional novel feature of the invention overcomes the limitations discussed previously concerning the channels 180 in the roller tubes 130 (shown in FIG. 1) used by different manufacturers. As shown in FIG. 9, a novel multiwelt adapter 400 is attached along the length of a top edge of the front panel 205. The adapter 400 has at least two welts, for example welts 405A and 405B, connected by shanks, for example 406A and 406B, to an adapter body 410. The welts 405 are shaped to fit channels 180 (shown in FIG. 1) made by different manufacturers. For example, the welts 405 could have different diameters as shown in FIG. 9, but they could also have different cross sectional shapes.

Figure 10:
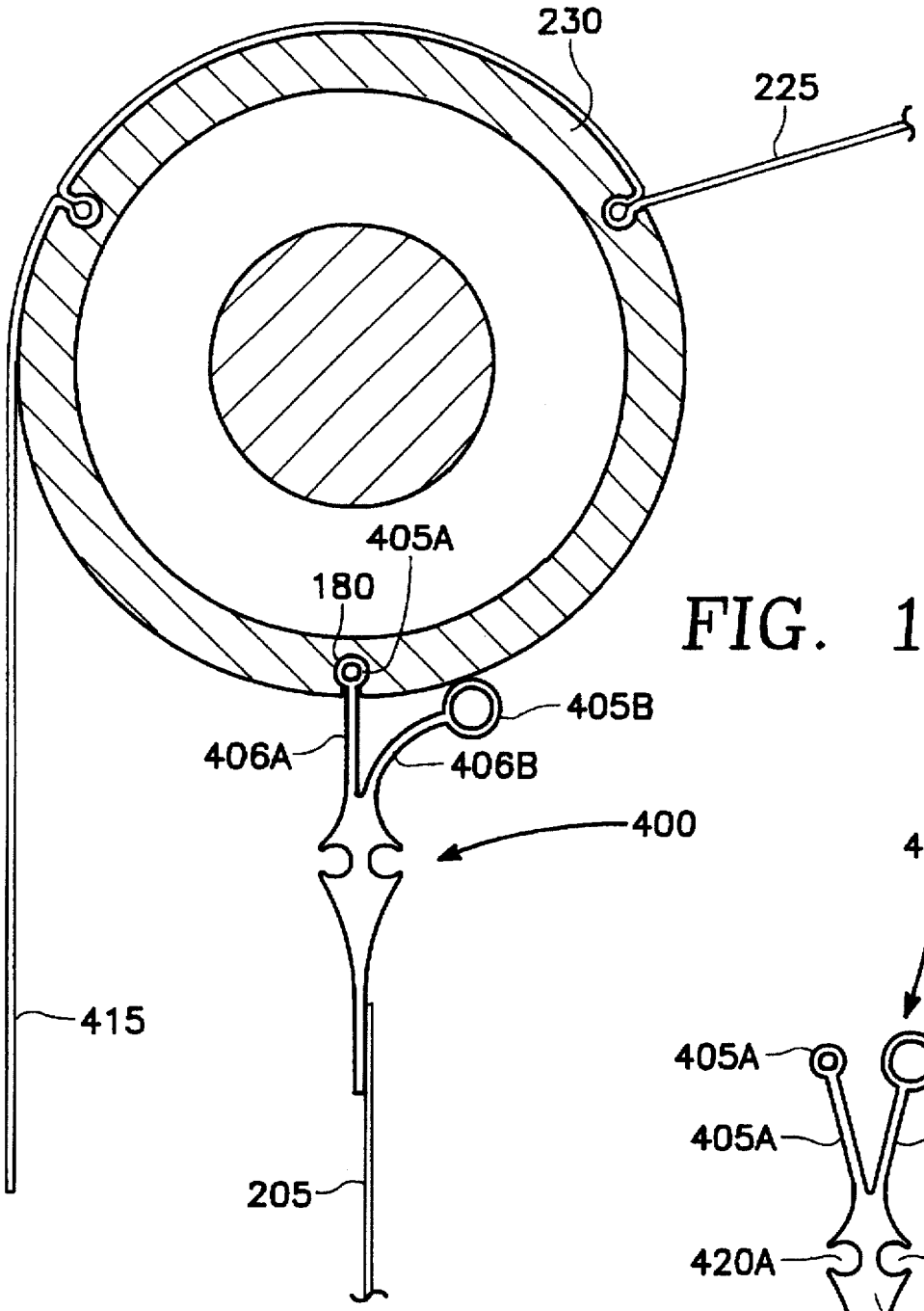
FIG. 10 is a side view of a multiwelt adapter of the invention engaged in a channel of a roller tube.

A typical installation is shown in FIG. 10 in which welt 405A is slid into the channel 180 and supports the front panel 205 and the unused welt 405B is moved to one side. The adapter 400 is made of a flexible material, such as vinyl, in order that the shank 406 of the used welt 405 flexed to one side. FIG. 10 also shows a valance 415 that is typically formed integral with the awning 225.

Figure 11:
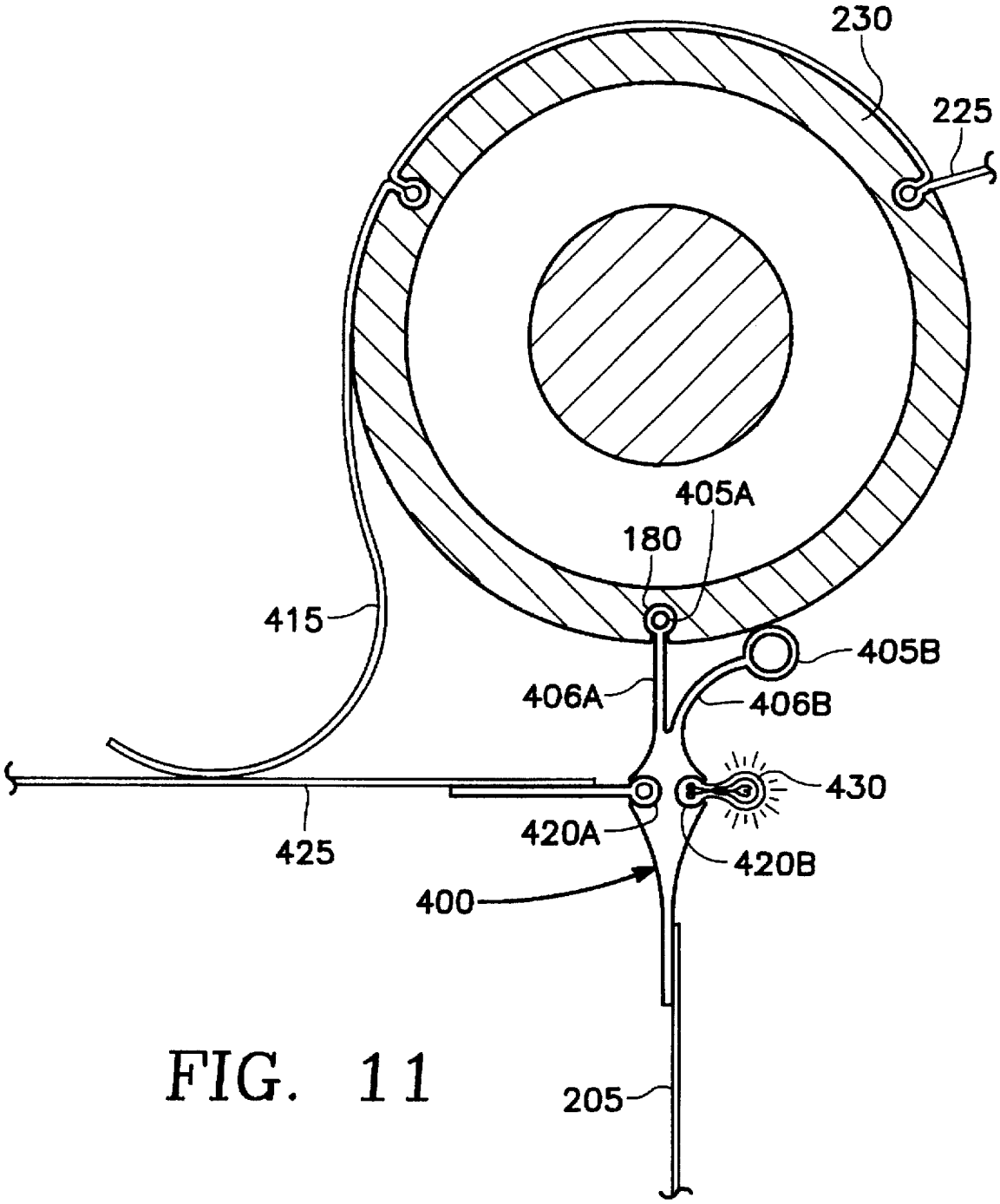
FIG. 11 is a side view of an awning extension and a light string engaged in a multiwelt adapter of the invention.

An additional feature of the novel adapter 400 is shown in FIG. 9 and consists of auxiliary grooves 420 on one or both sides of the adapter body 410. Additional accessories, such as an awning extension or lights may be inserted into these grooves. For example, FIG. 11 illustrates an awning extension 425 slid into the groove 420A and one or more lights, for example a string of lights 430, slid into the groove 420B. Although only one groove 420 is shown on each side of adapter 400, more than one groove 420 could be formed on each side, or none could be formed on one side.

Figure 12:
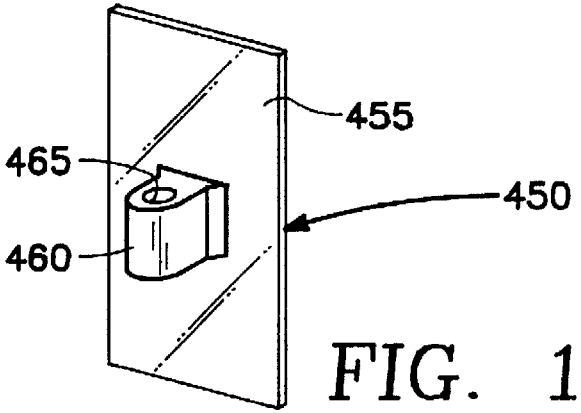
FIG. 12 is perspective view of a first embodiment of a surface clip of the invention.

Another novel feature of the invention overcomes the need for permanent fixtures to be fastened to the side of the RV to install the SRE. As shown in FIG. 2., a series of apertures 247 are formed in the side panel 210. The apertures 247 are used to provide an additional means of attaching the side panel 210 to the RV side 235 by means of a novel surface clip 450, a first embodiment of which is illustrated in FIG. 12. The surface clip 450 includes a planar section 455 and a protrusion 460. A channel 465 is formed in the protrusion 460 for insertion of a securing means to be described subsequently. A preferred material for the surface clip 450 is a transparent and flexible material, such as clear vinyl. The clip is attached to the RV side 235 by means of conventional means such as an acrylic adhesive.

Figure 13:
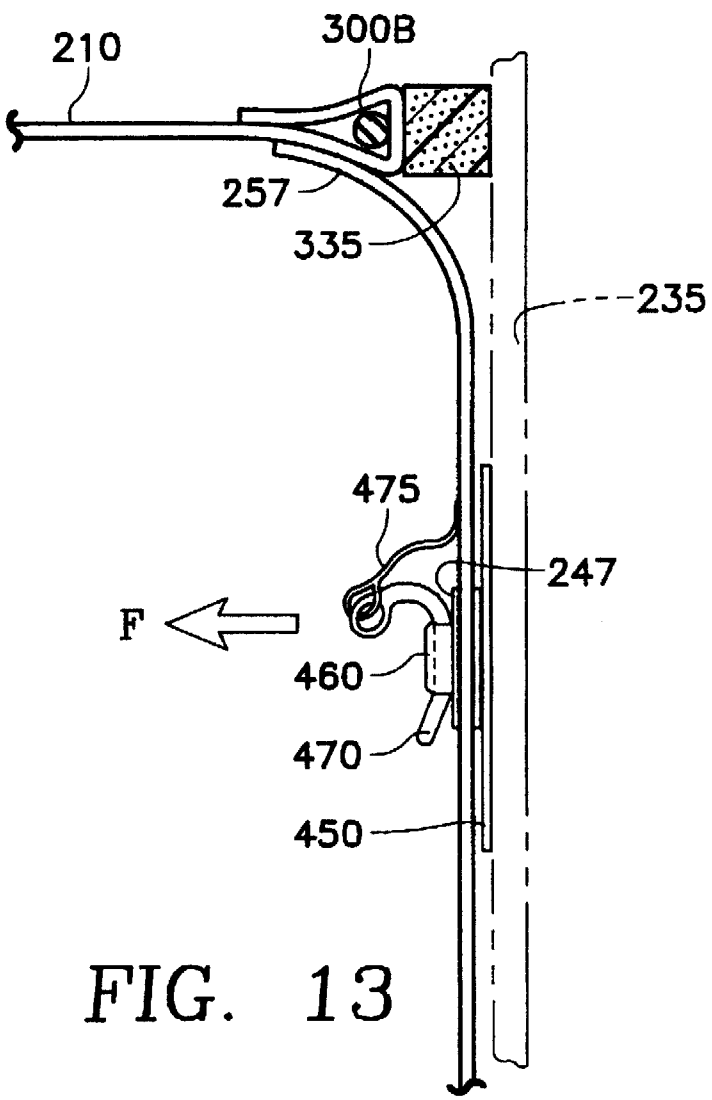
FIG. 13 is a side view of a side panel of an SRE of the invention coupled to an RV using the first embodiment of a surface clip of the invention.

One method of using the surface clip 450 is shown in FIG. 13. The surface clip 450 is glued to the RV side 235 in a position whereby the protrusion 460 extends through one of the apertures 247, which may be formed in a flap 257 coupled to the side panel 210. The aperture 247 is slid over the protrusion 460 and a pin 470 is slid into the channel 465, dimensioned to create a friction fit of the pin into the channel to avoid having the pin slid out of the channel. The interference of the pin 470 with the aperture 247 prevents the side panel 210 from lifting away from the RV side 235. The pin 470 could be attached to the flap 257 or side panel 210 with a tie-down 475 to prevent losing the pin. One skilled in the art will understand, however, that there are alternate means to position the apertures 247 adjacent the protrusion 460 to achieve the desired interference with the pin 470. For example, the apertures 247 could be formed in a portion of the side panel 210, which portion is flexed or folded to position the aperture adjacent the protrusion 460.

Once fastened to the RV side 235 using an adhesive, the surface clip 450 provides substantial resistance to being removed. When the flap 255 is pulled in an upward motion, a lifting force F is generated on the pin 470, which force is transferred to the protrusion 460. The lifting force F is distributed over the planar section 455 (shown in FIG. 12), reducing a real lifting forces acting on the surface clip 450. However, if one edge of the planar sections 455 is lifted, sufficient a real lifting forces are generated to remove the surface clip 450. In addition, when the surface clip 450 is removed in this manner, there is no damage to the RV side 235 and little residue from the adhesive. For these reasons, the surface clip 450 provides a strong attachment means that is adequate to secure the side panels 210 to the RV side 235, but one that may also be easily removed with no damage to the RV side.

Figure 14:
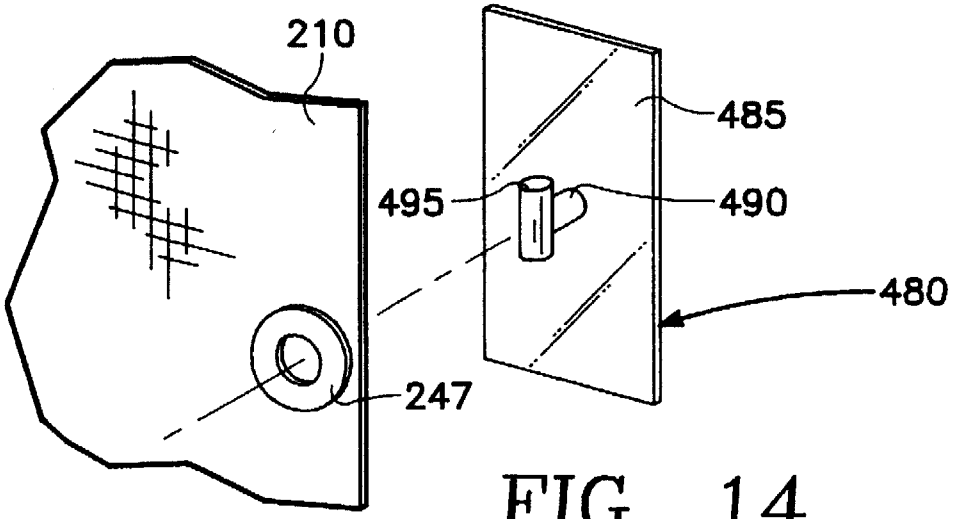
FIG. 14 is perspective view of a second embodiment of a surface clip of the invention and a portion of the side panel engageable with the clip.

An alternate embodiment of the surface clip 450 is shown in FIG. 14, in which an invisible clip 480 consists of a planar section 485 and an extension 490 having a "t" or "l" shape, with a leg 495 that is generally parallel to the support 485. The extension 490 is flexed or twisted in order to insert the extension through the aperture 247. As suggested previously, the aperture 247 in FIG. 14 is shown formed in a portion of the side panel 210 that has been flexed to position the aperture 247 adjacent to the extension 480. Once inserted, the interference of the leg 495 and the aperture 247 prevents the side panel from lifting away from the support 485.

Figure 15:
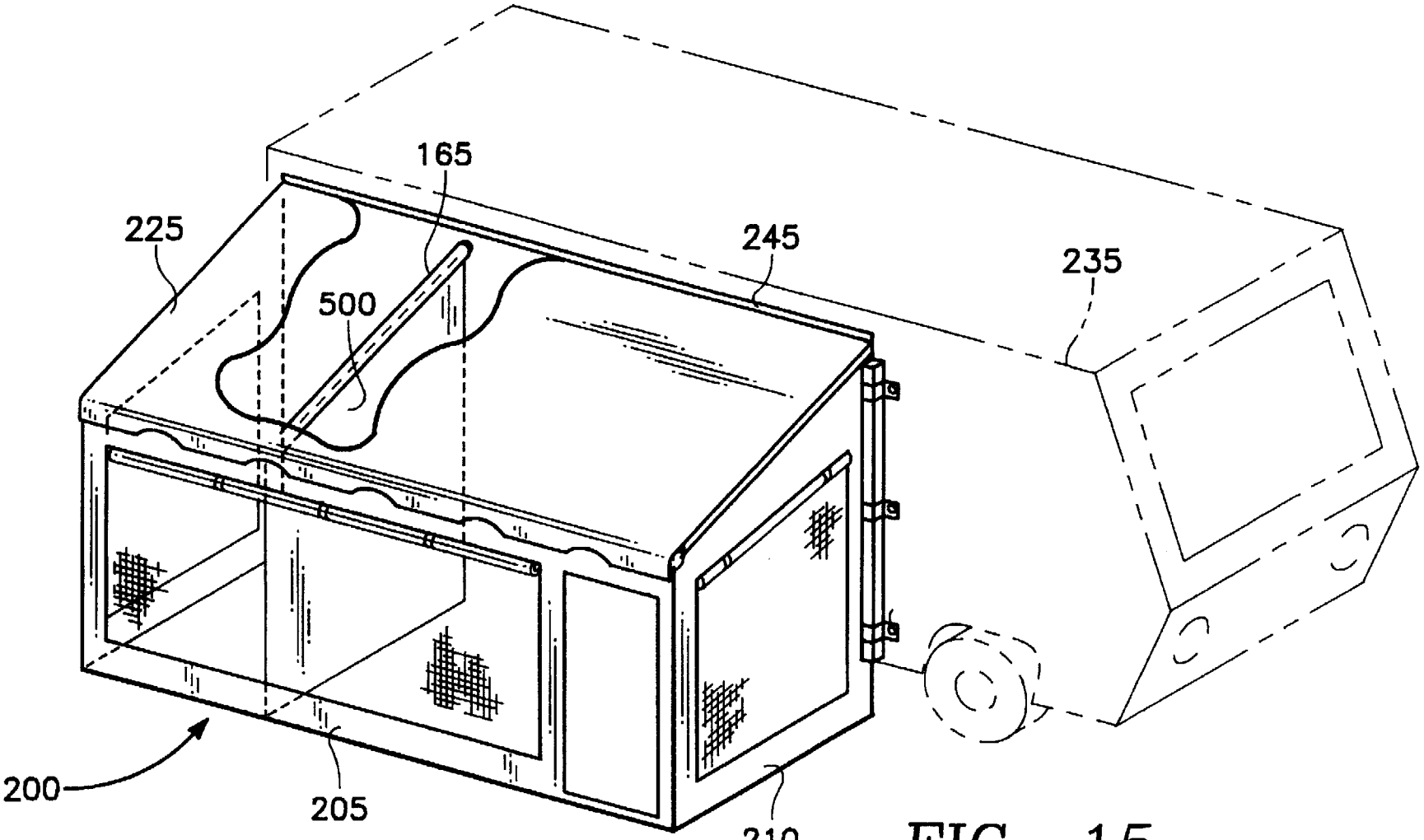
FIG. 15 is a perspective cut away view of a privacy wall of the invention.

Another novel feature of the invention expands the uses of an SRE by providing an element of privacy in a portion of the SRE. Frequently, the SRE is used in a manner to provide additional living space outside the RV prior art SREs have met this need by provided a single enclosed space, which design limits the utility of the SRE. This limitation is overcome by a novel feature shown in FIG. 15 of one or more privacy walls 500, which divide the living space into several separate living spaces. These separate spaces can be used for different activities that require a degree of privacy, such as sleeping or changing clothes.

The privacy wall 500 may be supported by using conventional means, such as the rafter 165 because obtaining a seal along the awning 225 and RV side 235 may not be as critical for a space that is on the interior of an SRE. Alternatively, the wall may be supported by using the clips 250 and elastic cord 300 of the invention (shown in FIG. 8.) in order to accomplish the objectives of no modifications to the RV, ease of installation, and lightweight components.

Another novel feature of the invention concerns the material of which the side panels 210, front panel 205 (both shown in FIG. 2) and privacy wall 500 (shown in FIG. 15) are made, prior art SREs have been fabricated of layered vinyl laminates, which provided a durable construction material. However, the vinyl laminates added undesirable weight and, consequently, were difficult to lift and position during the set up process. In addition, the vinyl laminates did not provide for the transmission of air, i.e., were not "breathable", which resulted in some discomfort for occupants when the privacy panels 115 are deployed to cover the screens 116 (shown in FIG. 1).

These limitations of the prior art material are overcome in the invention by the use of a spunbond polyolefin resin material, such as Tyvek made by Dupont Corporation, Laurel Run Bldg. P.O. Box 80705 Wilmington, Del. 19880, or spunbond polypropylene. This material is substantially lighter than the material used in prior art SREs, by as much as 90% percent. The spunbond polyolefin material is also breathable, which overcomes the discomfort experienced in prior art SREs because of a lack of breathability. In addition, the material of the invention has an increased resistance to ultraviolet radiation, which degrades the physical strength of the SRE. Thus, an SRE of the material of the invention will have a longer useful lifetime. In addition to exhibiting the foregoing advantages, the material of the invention retains the water resistant advantages of the prior art materials.

Although the present invention has been described with reference to preferred embodiments, workers skilled in the art will recognize that changes may be made in form and detail without departing from the spirit and scope of the invention.

What is claimed:

1. A screen room enclosure for use with a recreational vehicle having an awning rail, a roller tube with a channel, and an awning coupled at a first end to said awning rail and at a second end to the channel of said roller tube, said enclosure comprising:

a side panel having a top edge;

a first cord coupled to said top edge, said first cord having a first engagement means at an end adapted to be adjacent the awning rail and a second engagement means at a second end adapted to be adjacent said roller tube; and a first channel clip comprising:

a planar section having a slot engageable with said first engagement means, and a non-planar section adapted to be insertable between the awning rail and the end of the awning coupled thereto in a manner preventing interference of said planar section with said awning; and a second channel clip comprising:

a planar section having a slot engageable with said second engagement means, and a non-planar section engageable with said channel.

2. The enclosure of claim 1 wherein said first cord comprises an extendable elastic cord supporting said top edge adjacent said awning.

3. The enclosure of claim 1 wherein said recreational vehicle has a side, said enclosure further comprising:

a side edge of said panel placeable adjacent said recreational vehicle side;

a second cord coupled to said side edge and having a third engagement means at an end; and a third channel clip comprising:

a planar section having a slot engageable with said third engagement means;

a non-planar section engageable with said awning rail.

4. The enclosure of claim 3 further comprising:

a fastener coupled to another end of said second cord and being attachable to said RV.

5. The enclosure of claim 3 wherein at least one of said first, second and third engagement means comprises a loop.

6. The enclosure of claim 3 wherein at least one of said first, second, and third engagement means comprises a knot.

7. The enclosure of claim 3 further comprising:

a compressible strip coupled to said side edge and abutting said recreational vehicle for providing a seal.

8. The enclosure of claim 1 further comprising:

a compressible strip coupled to said top edge and abutting said awning for providing a seal.

9. The enclosure of claim 8 wherein said strip is a foam material.

10. The enclosure of claim 9, wherein said foam material is an open foam material.

11. The enclosure of claim 1, said enclosure further comprising:

a front panel having a top edge adjacent to said roller tube; and an adapter coupled to said top edge and comprising:

an adapter body a plurality of shanks coupled to said; and a plurality of welts having different cross sections, each weld being coupled to a respective one of said shanks, and one of said welts being engageable with said channel.

12. The enclosure of claim 11 wherein said adapter has first and second sides, and further comprises:

a longitudinal groove formed in at least one of said sides and being engageable with an element.

13. The enclosure of claim 12 wherein said element is another welt.

14. The enclosure of claim 12 wherein said element is a string of lights.

15. The enclosure of claim 11, wherein said front panel is made from a spunbond polyolefin resin material.

16. The enclosure of claim 15 where said spunbond polyolefin resin material is one of: (a) Tyvek, and (b) polypropylene.

17. The enclosure of claim 1 further comprising:

an aperture in said side panel; and a surface clip comprising:

a planar section adapted to be adhesively mounted on said recreational vehicle side; and a protrusion being engageable with said aperture and having a channel;

a pin being insertable in said channel and constraining a withdrawal of said protrusion from said aperture.

18. The enclosure of claim 17 wherein said side panel comprises a flap in which said aperture is formed.

19. The enclosure of claim 17 wherein said surface clip is comprised of a deformable material.

20. The enclosure of claim 19 wherein said deformable material is a vinyl.

21. The enclosure of claim 17 wherein said surface clip is comprised of a transparent material.

22. The enclosure of claim 1 further comprising:

an aperture in said side panel; and a surface clip comprising:

a planar section adapted to be adhesively mounted on said recreational vehicle side; and a protrusion insertable through said aperture and having a leg constraining a withdrawal of said protrusion from said aperture.

23. The screen room enclosure of claim 1 further comprising:

a front panel having a top edge coupled to said awning and two side edges;

a second side panel, said two side panels having front side edges coupled to said front panel side edges and back side edges adapted to be coupled to said recreational vechicle; and a privacy wall medial said side panels and having a front edge coupled to said front panel and a back edge adapted to be coupled to said RV.

24. The enclosure of claim 1 wherein said side panel is made of a spunbond polyolefin resin material.

25. The enclosure of claim 24 wherein said spunbond polyolefin resin material is Tyvek.

26. The enclosure of claim 1 further comprising:

a concave interior shape formed in said awning rail;

a convex exterior shape formed on said non-planar section mateable with said concave interior shape and rotatable within said concave interior shape while constraining displacement of said clip.

27. A channel clip for coupling engagement means to a recreational vehicle awning rail, said channel clip being engageable between the awning rail and an awning having an end coupled to said awning rail, said channel clip comprising:

a planar section having a slot engageable with said engagement means; and a non-planar section having an outward-facing arcuate end portion adapter to be insertable between the awning rail and the end of the awning coupled thereto said non-planar section, whenever inserted, being wedged between the awning rail and the end of the awning and held in place with the planar section extending generally downward from the awning in a manner preventing interference of said planar section with said awning.

28. The channel clip of claim 27 wherein said slot is generally parallel to said non-planar section.

29.The channel clip of claim 27 wherein said slot has a narrowed section adjacent an opening of said slot thereby constraining displacement of said engagement means.

* * * * *